US010130965B2

(12) United States Patent
Adamsson

(10) Patent No.: US 10,130,965 B2
(45) Date of Patent: Nov. 20, 2018

(54) DEVICE FOR SPRAYING A COATING CHEMICAL ONTO A MOVING SURFACE OF A PAPERMAKING MACHINE

(71) Applicant: Valmet Aktiebolag, Sundsvall (SE)

(72) Inventor: Karl Adamsson, Karlstad (SE)

(73) Assignee: Valmet Aktiebolag, Sundsvall (SE)

( * ) Notice: Subject to any disclaimer, the term of this patent is extended or adjusted under 35 U.S.C. 154(b) by 0 days.

(21) Appl. No.: 15/718,782

(22) Filed: Sep. 28, 2017

(65) Prior Publication Data

US 2018/0161794 A1 Jun. 14, 2018

(30) Foreign Application Priority Data

Dec. 8, 2016 (SE) ..... 1651619

(51) Int. Cl.

| | |
|---|---|
| ***D21G 3/00*** | (2006.01) |
| ***B05B 13/04*** | (2006.01) |
| ***B05B 1/04*** | (2006.01) |
| ***B05B 13/02*** | (2006.01) |
| ***B05B 1/30*** | (2006.01) |
| ***B05B 1/20*** | (2006.01) |

(Continued)

(52) U.S. Cl.

CPC ..... *B05B 13/041* (2013.01); *B05B 1/04* (2013.01); *B05B 1/20* (2013.01); *B05B 1/30* (2013.01); *B05B 13/0278* (2013.01); *B31F 1/14* (2013.01); *D21H 23/50* (2013.01)

(58) Field of Classification Search

USPC ..... 162/272, 199

See application file for complete search history.

(56) References Cited

U.S. PATENT DOCUMENTS 5,567,479 A * 10/1996 Rantanen ..... B05C 1/0817 118/104

5,783,044 A * 7/1998 Schneider ..... D21F 1/325 134/148

(Continued)

FOREIGN PATENT DOCUMENTS

WO WO 03076717 * 9/2003 ..... D21H 19/00

*Primary Examiner* — Mark Halpern

(74) *Attorney, Agent, or Firm* — Alston & Bird LLP

(57) ABSTRACT

A device for spraying a coating chemical onto a moving surface (1) of a papermaking machine includes a machine-wide box body (2) extending in a cross machine direction and defines an internal space configured to enclose part of a spraying equipment (3) and also defines an elongate opening (22) facing said moving surface (1). The spraying equipment (3) includes a plurality of spray nozzle members (30) for spraying coating chemical through said opening (22) onto the moving surface (1), a coating chemical supplying tube (32) is connected to the nozzle members (30), and a plurality of valves (33) are mounted on the coating chemical supplying tube (32), one for each nozzle member (30). To make it possible to change a nozzle member (30) without requiring that the coating chemical supplying tube (32) has to be pulled out of the box body (2), and where the nozzle change can be carried out with less risk for the operator to any danger, the coating chemical supplying tube (32) with said valves (33) is located outside of the box body (2), and the nozzle members (30) extend through a wall portion (36) of the box body (2) and are mounted to be individually movable axially to permit removal of anyone of them independently of the other ones.

13 Claims, 2 Drawing Sheets

(51) Int. Cl.
*B31F 1/14* (2006.01)
*D21H 23/50* (2006.01)

(56) References Cited

U.S. PATENT DOCUMENTS 6,203,858 B1 * 3/2001 Plomer ..... B05C 1/0813
118/316
6,248,407 B1 * 6/2001 Hess ..... B05B 5/04
239/419.3
6,326,055 B1 * 12/2001 Arai ..... B41M 5/52
427/195
6,494,954 B1 * 12/2002 Bernert ..... B05B 1/267
118/314
6,627,261 B1 * 9/2003 Vahakuopus ..... B05B 13/0207
118/62
6,866,207 B2 * 3/2005 Kangas ..... B05B 7/066
239/290
7,943,012 B2 5/2011 Backman et al.
2004/0074620 A1 * 4/2004 Nissinen ..... B82Y 30/00
162/135
2006/0049065 A1 * 3/2006 Chevalier ..... B31B 50/00
206/216

* cited by examiner

DEVICE FOR SPRAYING A COATING CHEMICAL ONTO A MOVING SURFACE OF A PAPERMAKING MACHINE

CROSS REFERENCE TO RELATED APPLICATIONS

This application claims priority to and the benefit of Swedish Patent Application No. 1651619-7, filed on Dec. 8, 2016, the contents of which as are hereby incorporated by reference in their entirety.

BACKGROUND

Related Field

The present invention relates to a device for spraying a coating chemical onto a moving surface of a papermaking machine, said device including a machine-wide box body extending in a cross machine direction and defining an internal space configured to enclose part of a spraying equipment and defining an elongate opening facing said moving surface, said spraying equipment including a plurality of spray nozzle members for spraying coating chemical through said opening onto the moving surface, a coating chemical supplying tube being connected to the spray nozzle members, and a plurality of valves being mounted on the coating chemical supplying tube, one for each nozzle member.

Description of Related Art

Crepe paper grades are produced by scraping off a paper web from a roll or drying cylinder, usually a Yankee dryer, to which it is adhered. The scraping is carried out by a doctor blade and causes a crinkling of the web and leads to an increased stretchability and softness of the paper web. To control the adhesion of the web to the Yankee dryer or other roll or drying cylinder, a coating chemical is sprayed onto the Yankee dryer or the like.

For the spraying of the coating chemical onto the moving surface, a device is used, which usually includes a machine-wide box body extending in a cross machine direction and defining a single-chamber internal space configured to enclose spraying equipment and defining an elongate opening facing said moving surface. The spraying equipment includes a plurality of spray nozzles for spraying coating chemical through said opening onto the moving surface, and a coating chemical supplying tube is connected to the spray nozzles. Such a device is disclosed in U.S. Pat. No. 7,943,012 B2 (Backman et al.), for example.

Traditionally, the protective cover is formed by an open ventilated box body placed under a Yankee dryer. Inside the box body and extending in the cross machine direction over the width of the machine one or more coating chemical supplying tubes are placed so as to spray coating chemical through nozzles onto the Yankee dryer. The coating chemical applied onto the Yankee dryer tends to spread in the machine, and the box body is adapted to prevent such spreading. The coating chemical supplying tubes consist of a tube with projecting nozzles, and the tube is axially displaceable on plastic bearings inside a larger tube. When a nozzle had to be changed, you either had to pull the coating chemical supplying tube out of the outer tube to make the change outside the machine, or you had to open a door in the box body to reach in and change the nozzle inside the box body.

There have also existed box bodies with spaces for two pivotal internal coating chemical supplying tubes but with only one coating chemical supplying tube in place in during operation of the machine. When changing the coating chemical supplying tube, a clean coating chemical supplying tube is inserted into the empty position of the rotary tube holder inside the box body. The tube holder is then rotated so that the new coating chemical supplying tube can start applying coating chemical and the earlier used tube can be extracted from the box body to be cleaned outside the machine. The coating chemical application has to be oscillatable over the width of the machine and be pivotal to direct the application of coating chemical away from the Yankee dryer when necessary.

The creping process, where a creping doctor scrapes loose the paper web from a Yankee dryer, will not result in a perfectly satisfactory quality, unless the application of the coating chemical is continuous. Consequently, the change of a nozzle has to be made quickly. The pulling out of the coating chemical supplying tube from the box body and the insertion of a new one takes too long time in relation to what the tissue manufacturing process permits. Alternatively, the changing of a nozzle through a door in the box body of a producing tissue machine is dangerous to the operator, as the nozzle is placed close to the hot, fast rotating Yankee dryer. Also this method is time consuming but the change can be made within the frame of time acceptable in the production process.

BRIEF SUMMARY

The object of the present invention is to provide a coating chemical spraying device, where a change of nozzle can be carried out without requiring that the coating chemical supplying tube has to be pulled out of the box body, and where the nozzle change can be carried out with a reduced risk of injury to the operator.

In a device of the kind referred to in the first paragraph above, this object is achieved in the device comprises: said coating chemical supplying tube with said valves being located outside of the box body; and said nozzle members being carried by the box body, extend through a wall portion of the box body, and being mounted to be individually movable axially to permit removal of anyone of them independently of the other ones.

Thereby it becomes possible for an operator to stop the supply of coating chemical to a malfunctioning nozzle member while maintaining the supply to the other nozzle members, then remove the malfunctioning nozzle member and mount a new nozzle member, and finally start the supply of coating chemical to the new nozzle member. All of these steps can be carried out with a reduced risk of injury for the operator and with less risk of jeopardizing the quality of the tissue paper produced during the change of nozzle member.

The nozzle members may be integral units, but for cost reasons they preferably are nozzled plug-in tubes, where each nozzled plug-in tube includes a nozzle mounted to one end of an associated plug-in tube.

The nozzle members usually are reciprocated in the cross machine direction. In order not to have to reciprocate also the coating chemical supply tube, it is preferred that a plurality of tubular conduits, one for each nozzle member, connect each valve to an associated one of the nozzle members.

To facilitate the exchange of a faulty nozzle member, the tubular conduits suitably are hoses.

To facilitate the exchange of a faulty nozzle member, it is suitable that the nozzle members are locked to said wall portion of the box body by a connector, preferably one that requires a relative rotary motion between the nozzle member and the connector for locking and unlocking, whereby each nozzle member easily can be fixed in a predetermined orientation. Such a connector can be a bayonet mount, for example.

Nozzle members giving a full cone spray can be used, but preferably, the nozzle members deliver flat fan spray jets that overlap one another and are oriented skewed in such a manner, that adjacent nozzles are mounted rotated with a specific offset angle to avoid interference and produce a uniform spray coverage when their jets overlap. Thereby, the influence of a faulty nozzle and the exchange thereof on the quality of the creping of the tissue web is minimized.

The box body suitably is of a design such that the nozzle members may be removed from the box body in a direction outward from the Yankee dryer, and the box body preferably includes a platform, in which the nozzle members are mounted. This platform constitutes said wall portion of the box body. However, in some cases it may be desirable to pivot the platform through an angle of about a quarter of a full turn to a generally horizontal plane in order not to spray the coating chemical onto the moving surface of the papermaking machine. Then it is suitable that the platform includes a longitudinal shaft that extends in the cross machine direction and is mounted to be pivotal between a first position for directing the sprayed coating chemical onto the moving surface and a second position for directing it toward an inner wall of the box body. The pivotal movement preferably is about a quarter of a full turn.

Further, to ensure a uniform coating of the sprayed coating chemical on the moving surface, e.g. the Yankee dryer surface, the platform is preferably mounted to be oscillatory in the cross machine direction.

When the aqueous coating chemical hits the hot surface of a Yankee dryer, for example, a mist is created which contains vapor and non-evaporated water from the sprayed coating chemical, but also residues of chemicals which are not attaching to the Yankee surface or do not reach the Yankee surface for some reason, e.g. as a result of the spraying liquid being influenced in an undesired way by lateral forces from the boundary layer air flows which are created along the shell surface as a result of the high speed of rotation of the Yankee cylinder. The chemical-containing mist is carried away from the place of application by local air streams which mainly are produced by the fast production of said water vapor, by convection, by said boundary layer air flows along the shell surface, and by air streams along a clothing running around the adjacent press roll, e.g. a felt or wire running around a suction press roll. The local air streams created in this way and bringing the chemical-containing mist with them, are difficult to control and they can spread out into the surroundings both in the dry end of the tissue machine as well as outside of it, with accompanying problems. Therefore, it is also suitable that the box body has at least one outlet adapted to be connected to a ventilating system.

BRIEF DESCRIPTION OF THE FIGURES

In the following, the invention will be described in more detail with reference to preferred embodiments and the appended drawings.

DETAILED DESCRIPTION OF VARIOUS EMBODIMENTS

Figure 1:
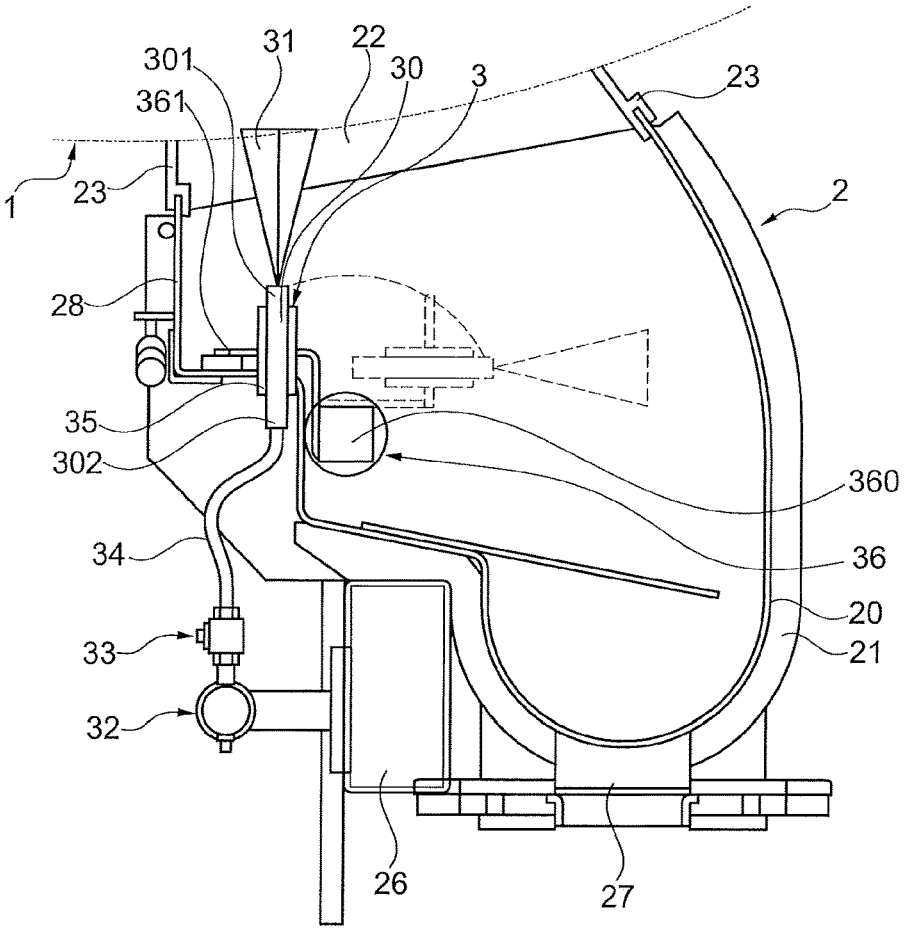
FIG. 1 is a cross-sectional view of a preferred embodiment of the spraying device of the present invention for spraying a coating chemical onto a moving surface of a papermaking machine.

FIG. 1 shows a preferred embodiment of the spraying device of the present invention for spraying a coating chemical onto a moving surface 1 of a papermaking machine. In the shown embodiment the moving surface is the rotary envelope surface 1 of a Yankee dryer in a tissue machine, but it could be any rotary roll or even a fibrous web, if desired. The device includes a machine-wide box body 2 extending in a cross machine direction. The box body 2 has a circumferentially curved longitudinal wall 20 of steel plate and is reinforced by external ribs 21, and it has an elongate opening 22 facing said moving surface 1.

The device also includes a plurality of spray nozzle members 30 of a spraying equipment 3 for spraying coating chemical through said opening 22 onto the moving surface 1, and the box body 2 has an internal space configured to enclose the nozzle members 30. The spraying equipment also includes a coating chemical supplying tube 32 that is connected to the nozzle members 30, and a plurality of valves 33 that are mounted on the coating chemical supplying tube 32, one for each nozzle member 30.

In accordance with the present invention, the coating chemical supplying tube 32 with said valves 33 is located outside of the box body 2, and the nozzle members 30 are carried by the box body 2 and mounted to be individually movable axially to permit removal of anyone of the nozzle members 30 independently of the other ones.

By closing the valve 33 that is associated with a malfunctioning nozzle member 30, an operator can stop the supply of coating chemical to the malfunctioning nozzle member 30 while maintaining the supply to the other nozzle members 30. Then he can remove the malfunctioning nozzle member 30 and mount a new one, and finally open said associated valve 33 to start the supply of coating chemical to the new nozzle member 30. All of these steps can be carried out with a reduced risk of injury to the operator and with a reduced risk of jeopardizing the quality of the tissue paper produced during the change of nozzle member 30.

Figure 4:
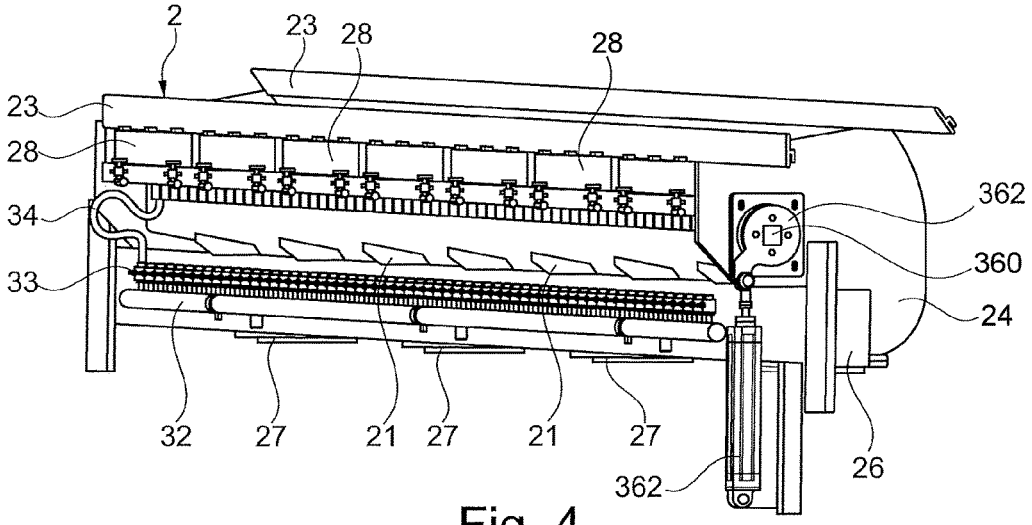
FIG. 4 is an isometric view of the device of FIG. 1 showing a mechanism for pivoting the platform and the nozzle members carried thereby.
Figure 5:
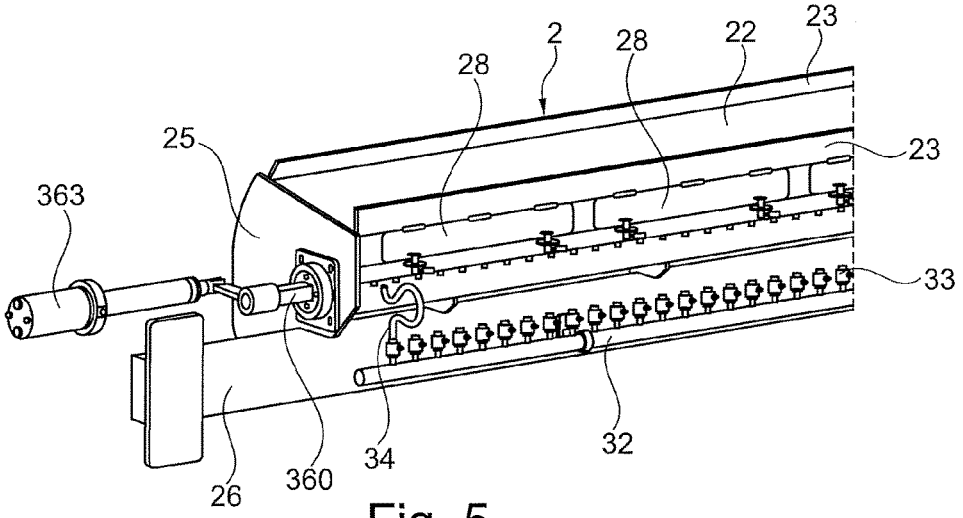
FIG. 5 is an isometric view from another angle showing a mechanism for reciprocating the platform and the nozzle members carried thereby.

The nozzle members 30 may be integral units, but for cost reasons they preferably are nozzled plug-in tubes, where each nozzled plug-in tube includes a nozzle 301 mounted to one end of an associated plug-in tube 302. The plug-in tubes 302 have an outer diameter that is larger than a corresponding width of the nozzle 301. A plurality of tubular conduits 34, one for each nozzle member 30, connect each valve 33 to an associated one of the nozzle members 30. To provide the possibility of oscillating the nozzle members 30 in the cross-machine direction and to pivot them in the machine direction, the tubular conduits preferably are hoses 34. In FIGS. 4 and 5 only one of the plurality of hoses 34 is shown in order not to crowd the figures with details that are unnecessary for the understanding of the figure.

Figure 2:
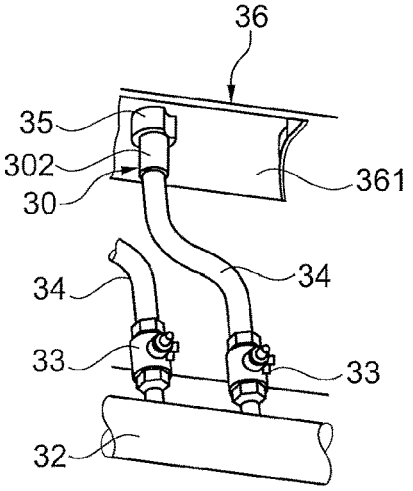
FIG. 2 is an isometric view of a portion of the spraying device of FIG. 1 showing a nozzle member mounted in a platform and receiving the coating through a hose conduit from a valve connected to a supply tube.
Figure 3:
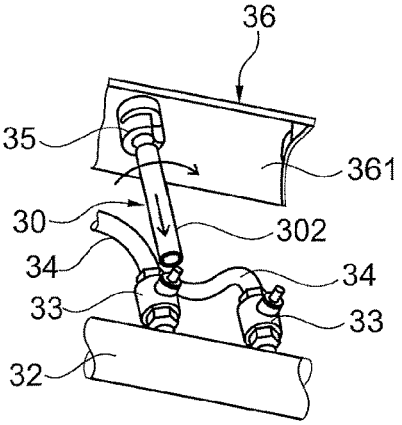
FIG. 3 is an isometric view similar to the one of FIG. 2 but showing a the nozzle member during removal from the platform.

As is best shown in FIGS. 2 and 3, to facilitate the exchange of a faulty nozzle member 30, it is suitable that they are locked to said wall portion 36 of the box body by a connector 35, preferably one that requires a relative rotary motion between the nozzle member 30 and the connector 35 for locking and unlocking, whereby each nozzle member 30 easily can be fixed in a predetermined orientation. Such a connector 35 can be a bayonet mount, for example. As the plug-in tubes 302 have an outer diameter that is larger than a corresponding width of the nozzle 301, the nozzle member 30 can easily be pulled out through the connector 34.

Figure 6:
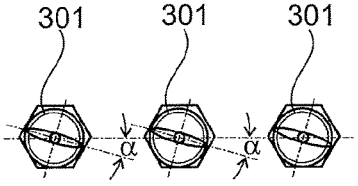
FIG. 6 is a plan view of three nozzles of a type that delivers flat fan spray jets and are mounted rotated with a specific offset angle.
Figure 7:
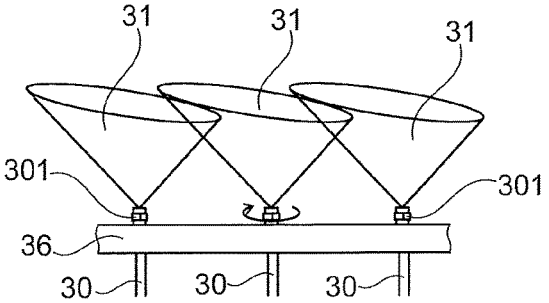
FIG. 7 is a schematic side view of three nozzle members of FIG. 6 mounted in a platform and delivering flat fan spray jets that overlap one another and are oriented skewed to avoid interference and produce a uniform spray coverage when their jets overlap.

Nozzle members giving a full cone spray jet can be used, but as best shown in FIGS. 6 and 7, the nozzle members 30 preferably deliver flat fan spray jets 31 that overlap one another and are oriented skewed in such a manner, that adjacent nozzles 30 are mounted rotated with a specific offset angle $\alpha$ to avoid interference and produce a uniform spray coverage when their jets overlap. Thereby, the influence of a faulty nozzle 30 and the exchange thereof on the quality of the creping of the tissue web from a Yankee dryer 1 is minimized.

As shown in FIG. 1 the box body 2 is designed so as to permit the nozzle members 30 to be removed from the box body 2 in a direction outward from the Yankee dryer 1. The box body 2 preferably includes a platform 36, in which the nozzle members 30 are mounted, and the platform constitutes said wall portion 36 of the box body 2. The box body 2 is carried by a beam 26 that extends parallel to the box body 2 and is adapted to be fixed to a frame of the papermaking machine. In the shown embodiment the beam 2 is a box beam which also carries the coating supplying tube 34. As a rule, it is desirable to pivot the platform 36 through an angle of about a quarter of a full turn to a generally horizontal plane (the position is shown in broken lines in FIG. 1) in order not to spray the coating chemical onto the moving surface 1 of the papermaking machine.

Then it is suitable that the platform 36 includes a longitudinal shaft 360 that extends in the cross machine direction and a longitudinal bar 361 of L-shaped cross-section extending along the shaft 360. In the shown embodiment, the shaft 360 has a square cross-section, and one flange of the L-bar is attached to one long side of the shaft 360. The nozzle members 30 extend through the other flange of the L-bar and are attached thereto by the connectors 35. The platform 36 is mounted to be pivotal on a longitudinal axis of the shaft 360 between a first position (shown in solid lines in FIG. 1) for directing the sprayed jet 31 of coating chemical onto the moving surface 1 and a second position (shown in broken lines in FIG. 1) for directing it toward an inner wall of the box body 2. The pivotal movement preferably is about a quarter of a full turn and is achieved by operating a crank mechanism 362 shown in FIG. 4 and located axially outside a first end 24 of the box body 2. Thus, the curved plate wall 20 of the box body 2 has a longitudinal slot that is covered by the wall portion/platform 36, when the jets 31 are directed toward the moving Yankee surface, but will be opened when the platform 36 is pivoted to direct the jets 31 toward the inner wall of the box body 2. In the shown embodiment, the crank mechanism 362 includes a crank and an actuator for rotating the crank. The crank is fixed to a first end of the shaft 360 in such a manner that a rotation of the crank makes the shaft rotate but that the shaft can move axially in relation to the crank. The actuator suitably is fixed to the beam 26 as shown in FIG. 4.

Further, to ensure a uniform coating of the sprayed coating chemical on the moving surface, e.g. the Yankee dryer surface 1, the platform 36 is preferably mounted to be oscillatory in the cross machine direction. The oscillating movement is achieved by an oscillator 363 shown in FIG. 5 and located axially outside a second end 25 of the box body 2. In the shown embodiment, the oscillator 363 includes an actuator connected to a second end of the shaft 360 by a coupling permitting rotation of the shaft 360 but preventing an axial movement of the shaft 360 relative the coupling.

When the moving surface is the hot surface of a Yankee dryer, for example, which is hit by the aqueous coating chemical, a mist is created, which contains vapor and non-evaporated water from the sprayed coating chemical, but also residues of chemicals which are not attaching to the Yankee surface or do not reach the Yankee surface for some reason, e.g. as a result of the spraying liquid being influenced in an undesired way by lateral forces from the boundary layer air flows which are created along the shell surface as a result of the high speed of rotation of the Yankee cylinder. The chemical-containing mist is carried away from the place of application by local air streams which mainly are produced by the fast production of said water vapor, by convection, by said boundary layer air flows along the shell surface, and by air streams along a clothing running around the adjacent press roll, e.g. a felt or wire running around a suction press roll. The local air streams created in this way and bringing the chemical-containing mist with them, are difficult to control and they can spread out into the surroundings both in the dry end of the tissue machine as well as outside of it, with accompanying problems. Therefore, it is preferred that the long sides of the box body opening 22 are provided with sealing strips 23, and further that the box body 2 has at least one outlet 27 adapted to be connected to a ventilating system. If desired, the box body may be provided with inspection doors 28, best shown in FIGS. 1 and 4, permitting inspection of the jets 31 from the nozzle members 30.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

Of note, the device of the present invention is applicable for spraying a coating chemical onto a moving surface of a papermaking machine, especially the envelope surface of a Yankee dryer in a tissuemaking machine.

The invention claimed is:

1. A device for spraying a coating chemical onto a moving surface (1) of a papermaking machine, said device comprising:

a machine-wide box body (2) extending in a cross machine direction and defining an internal space configured to enclose part of a spraying equipment (3) and defining an elongate opening (22) facing said moving surface (1), said spraying equipment (3) including a plurality of spray nozzle members (30) for spraying coating chemical through said opening (22) onto the moving surface (1), a coating chemical supplying tube (32) being connected to the nozzle members (30), and a plurality of valves (33) being mounted on the coating chemical supplying tube (32), one for each nozzle member (30), wherein:

said coating chemical supplying tube (32) with said valves (33) is located outside of the box body (2); and said nozzle members (30) are carried by the box body (2), extend through a wall portion (36) of the box body (2), and are mounted to be individually movable axially to permit removal of anyone of them independently of the other ones.

2. A device as claimed in claim 1, wherein the nozzle members (30) are nozzled plug-in tubes, where each nozzled plug-in tube (30) includes a nozzle (301) mounted to one end of an associated plug-in tube (302).

3. A device as claimed in claim 1, wherein a plurality of tubular conduits (34), one for each nozzle member (30), connect each valve (33) to an associated one of the nozzle members (30).

4. A device as claimed in claim 3, wherein the tubular conduits (34) are hoses.

5. A device as claimed in claim 1, wherein the nozzle members (30) are locked to said wall portion (36) of the box body (2) by a connector (35).

6. A device as claimed in claim 5, wherein each nozzle member (30) is fixed in a predetermined orientation by a connector (35) requiring a relative rotary motion between the nozzle member (30) and the connector (35).

7. A device as claimed in claim 6, wherein the nozzle members (30) deliver flat fan spray jets (31) that overlap one another and are oriented skewed in such a manner, that adjacent nozzle members (30) are mounted rotated with a specific offset angle (a) to avoid interference and produce a uniform spray coverage when their jets (31) overlap.

8. A device as claimed in claim 5, wherein each nozzle member (30) is locked to the box body (2) by a bayonet mount (35).

9. A device as claimed in claim 5, wherein the box body (2) includes a platform (36) in which the nozzle members (30) are mounted, said platform constituting said wall portion (36) of the box body (2).

10. A device as claimed claim 9, wherein the platform (36) includes a longitudinal shaft (360) extending in the cross machine direction and is mounted to be pivotal on said shaft (360) between a first position for directing the sprayed coating chemical onto the moving surface (1) and a second position for directing it toward an inner wall of the box body (2).

11. A device as claimed in claim 10, wherein the pivotal movement is a quarter of a full turn.

12. A device as claimed in claim 9, wherein the platform (36) is mounted to be oscillatory in the cross machine direction.

13. A device as claimed in claim 1, wherein the box body (2) has at least one outlet (27) adapted to be connected to a ventilating system.

* * * * *